US005857857A

United States Patent [19]

Fukuda

[11] Patent Number: 5,857,857

[45] Date of Patent: Jan. 12, 1999

[54] CONNECTOR STRUCTURE

[75] Inventor: Eiji Fukuda, Shizuoka, Japan

[73] Assignee: Yazaki Corporation, Tokyo, Japan

[21] Appl. No.: 852,282

[22] Filed: May 7, 1997

[30] Foreign Application Priority Data

May 17, 1996 [JP] Japan ..... 8-123537

[51] Int. Cl.[6] ..... H01R 13/703

[52] U.S. Cl. ..... 439/188; 439/862

[58] Field of Search ..... 439/188, 189, 439/862

[56] References Cited

U.S. PATENT DOCUMENTS 4,904,196 2/1990 Sueyoshi et al. ..... 439/188
5,674,084 10/1997 Fukamachi ..... 439/188

FOREIGN PATENT DOCUMENTS 1-77287 5/1989 Japan .

*Primary Examiner*—Neil Abrams
*Assistant Examiner*—Javaid Nasri
*Attorney, Agent, or Firm*—Sughrue, Mion, Zinn, Macpeak & Seas, PLLC

[57] ABSTRACT

A connector structure, having a short-circuiting member, includes a housing, terminal receiving chambers formed in the housing, a short-circuiting member receiving chamber communicating with the terminal receiving chambers, the short-circuiting member having resilient contact plate portions formed thereon, the short-circuiting member being received in the short-circuiting member receiving chamber, so that the contact plate portions project respectively into the terminal receiving chambers to be press-contacted respectively with terminals mounted respectively in the terminal receiving chambers, and a contact plate portion urging unit urging the contact plate portions against a resilient force thereof to thereby limit an amount of projection of the contact plate portions into the terminal receiving chambers to a predetermined value.

4 Claims, 6 Drawing Sheets

CONNECTOR STRUCTURE

BACKGROUND OF THE INVENTION

This invention relates to a connector structure having a short-circuiting member for removing a potential difference between terminals.

In a circuit in which a load and a power source are connected together by a connector, an electric current may be induced in a load-side circuit by electromagnetic waves and static electricity when the connector is not in a connected condition. In this case, due to the difference in current intensity between signal lines, there is a possibility that a voltage develops between the signal lines, so that an equipment (load) is subjected to a malfunction. For example, in an air bag circuit in which an ignition signal is fed to an ignition device so as to inflate an air bag, such a situation should be avoided by all means so as to secure safety during the travel.

A connector structure, having a short-circuiting member for removing a potential difference between terminals, will be described with reference to FIGS. 8 to 10 (the connector structure shown in FIGS. 8–12 are not prior art for the present application). FIG. 8 is a cross-sectional view of the connector structure having the short-circuiting member, FIG. 9 is an exploded, perspective view of an important portion of the connector structure, and FIG. 10 is a cross-sectional view showing a condition in which terminals and an insulating plate of a mating connector are inserted into the connector of FIG. 8.

Terminal receiving chambers 3 are formed in a housing 1, and are open at one end thereof to a front surface of the housing 1 to form connection ports 5 for receiving the mating terminals, and are also open at the other end thereof to a rear surface of the housing 1 to form mounting ports 9 for receiving terminals 7. An elastic retaining piece portion 11 is provided in the terminal receiving chamber 3, and is retainingly engaged in an engagement hole 13, formed in the terminal 7, to retain the terminal against withdrawal. The terminals 7 are connected, for example, to an air bag ignition device (load).

A short-circuiting member 15, made of an electrically-conductive metal sheet, is mounted below the terminal receiving chambers 3 (that is, at a lower portion in FIG. 8). As shown in FIG. 9, the short-circuiting member 15 has a pair of contact plate portions 17 and 17. The contact plate portions 17 and 17 project respectively into the juxtaposed terminal receiving chambers 3 provided in the housing 1. Each of the contact plate portions 17 and 17 has a mountain-like shape having a peak at its central portion, and has front and rear slanting surfaces 19*a* and 19*b*.

The short-circuiting member 15 is attached to the housing 1 before mounting the terminals 7. When each terminal 7 is inserted into the associated terminal receiving chamber 3, the terminal 7 first abuts at its distal end against the slanting surface 19*b*, and forces the contact plate portion 17 out of the terminal receiving chamber 3, so that the contact plate portion 17 is held in press-contact with the terminal 7, as shown in FIG. 8.

Therefore, the pair of terminals 7 and 7, received respectively in the pair of terminal receiving chambers 3, are electrically connected together by the short-circuiting member 15, thereby removing a potential difference between the terminals in a non-connected condition of the connector. As shown in FIG. 10, the mating connector, connected to a power source, includes projecting terminals 21 and an insulating plate 23, and when the two connectors are connected together, the insulating plate 23 is inserted between the pair of terminals 7 and 7 and the pair of contact plate portions 17 and 17.

In the above connector structure related to the present invention, the terminals 7 and 7 are connected to a power source-side circuit when the two connectors are connected together, and when the two connectors are not connected together, the terminals 7 and 7 are short-circuited together, thereby removing a potential difference therebetween, thus positively preventing a malfunction of the electronic circuit.

In the above related connector structure, however, the contact plate portions 17 of the short-circuiting member 15 project far into the respective terminal receiving chambers 3 as shown in FIGS. 11 and 12 so that they can contact the respective terminals 7 with a sufficient contact pressure, and therefore when the terminal 7 is inserted, the distal end of the terminal 7 sometimes fails to properly abut against the slanting surface 19*b* of the contact plate portion 17 as shown in FIG. 11, and forces the contact plate portion 17 upward, which leads to a possibility that the terminal 7 or the contact plate portion 17 is damaged. To avoid this, if the amount of projection of the contact plate portion 17 into the terminal receiving chamber 3 is reduced, the load (or pressure) of contact of the contact plate portion 17 with the terminal 7 is reduced, which causes the increase of a resistance or the incomplete contact.

SUMMARY OF THE INVENTION

The present invention has been made in view of the above problems, and an object of the invention is to provide a connector structure in which when inserting each terminal, a distal end of the terminal can be positively abutted against and guided by a slanting surface of a contact plate portion, and also a high load of contact of the contact plate portion with the terminal can be secured, thereby enhancing the efficiency of the inserting operation and the contact reliability.

To achieve the above object, according to the present invention, there is provided a connector structure characterized by the provision of: a housing; terminal receiving chambers formed in the housing; a short-circuiting member receiving chamber communicating with the terminal receiving chambers; a short-circuiting member having resilient contact plate portions formed thereon, the short-circuiting member being received in the short-circuiting member receiving chamber, so that the contact plate portions project respectively into the terminal receiving chambers to be press-contacted respectively with terminals mounted respectively in the terminal receiving chambers; and contact plate portion urging means urging the contact plate portions against a resilient force thereof to thereby limit an amount of projection of the contact plate portions into the terminal receiving chambers to a predetermined value.

In this connector structure, the position of the contact plate portions of the short-circuiting member is limited by the contact plate portion urging means, so that the amount of projection of the contact plate portions into the terminal receiving chambers is kept to the predetermined value, and a slanting surface (serving as a terminal guide surface), formed on each of the contact plate portions, is accurately positioned in a path of insertion of the terminal. When each terminal is inserted into the terminal receiving chamber, the terminal abuts at its distal end against the slanting surface of the contact plate portion, and presses the contact plate portion downward. As a result, the thus depressed contact plate portion is brought into press-contact with a lower surface of the terminal, mounted in the terminal receiving chamber, with a large resilient restoring force. At this time, the press-contact force is usually the sum of the force of press-contact of the contact plate portion with the contact plate portion urging means and the resilient restoring force resulting from the depressing of the contact plate portion by the terminal.

DETAILED DESCRIPTION OF THE INVENTION

Figure 1:
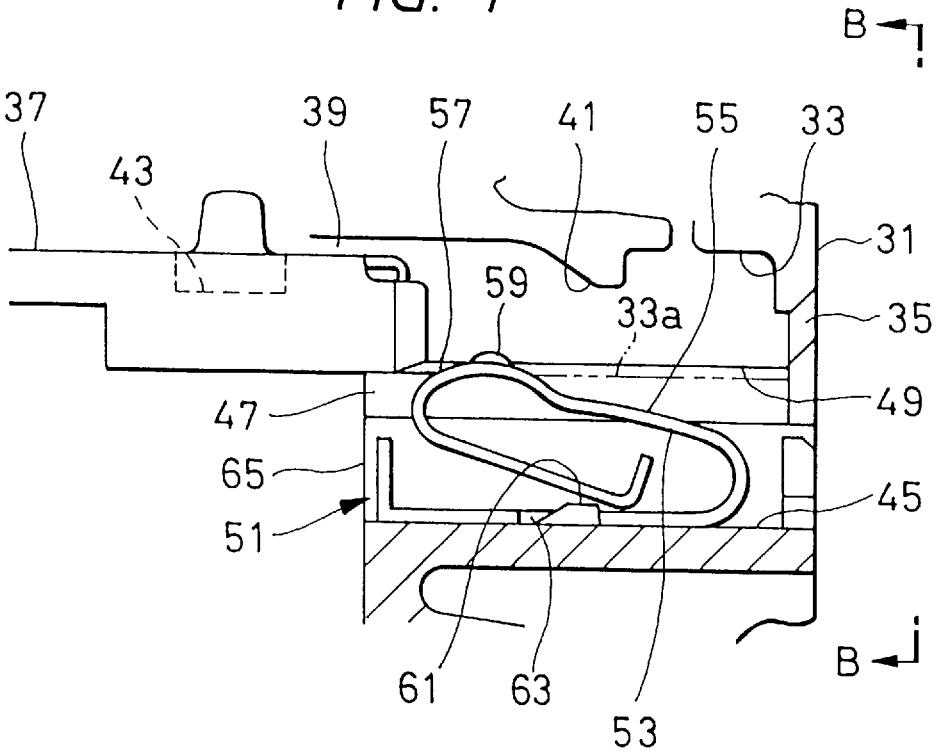
FIG. 1 is a cross-sectional view of a first embodiment of a connector structure of the present invention, showing the process of inserting a terminal.
Figure 2:
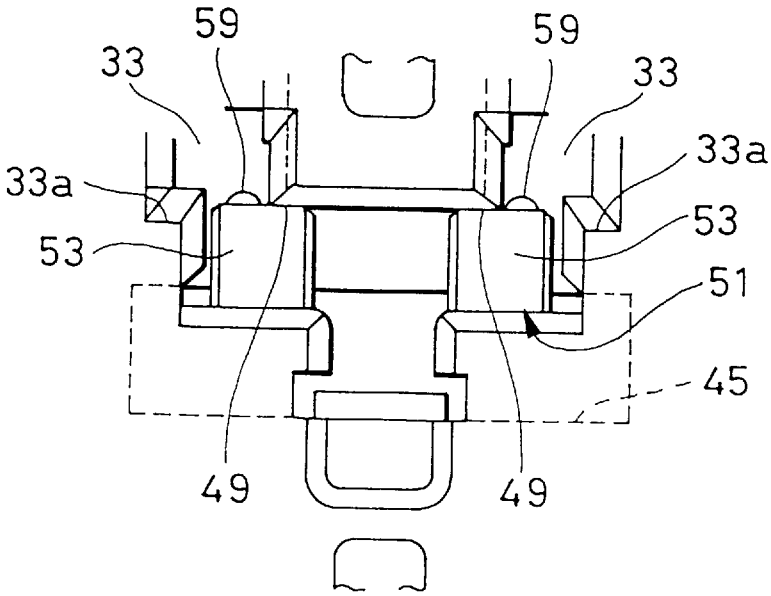
FIG. 2 is a view seen along line II—II of FIG. 1.

Preferred embodiments of a connector structure of the present invention will now be described in detail with reference to the drawings. FIG. 1 is a cross-sectional view of a first embodiment of the connector structure of the invention, showing the process of inserting a terminal, and FIG. 2 is a view seen along line II—II of FIG. 1.

Terminal receiving chambers 33 are formed in a housing 31, and are open at one end thereof to a front surface of the housing 31 to form connection ports 35 for receiving mating terminals, and are also open at the other end thereof to a rear surface of the housing 31 to form mounting ports 39 for receiving terminals 37. Each of the terminals 37 is inserted through the mounting port 39, and is mounted in the associated terminal receiving chamber 33 in such a manner that an elastic retaining piece portion 41, provided in the terminal receiving chamber 33, is retainingly engaged in an engagement hole 43 in the terminal 37. The terminals 37 are connected, for example, to an air bag ignition device (load).

A short-circuiting member receiving chamber 45 is formed below the terminal receiving chambers 33 (that is, at a lower portion in FIG. 1), and the short-circuiting member receiving chamber 45 communicates with the terminal receiving chambers 33 through a communication portion 47. Step portions 49, serving as contact plate portion urging means, are formed at that portion of the communication portion 47 disposed adjacent to the terminal receiving chambers 33, and the step portions 49 constitute part of an upper surface (ceiling) of the short-circuiting member receiving chamber 45.

A short-circuiting member 51, formed by working an electrically-conductive metal sheet, is mounted in the short-circuiting member receiving chamber 45. The short-circuiting member 51 has a pair of contact plate portions 53 and 53 each having a front portion bent back. Each of the contact plate portions 53 has a mountain-like shape having a peak at its central portion, and has front and rear slanting surfaces 55 and 57. A contact 59 is formed on the peak portion of the contact plate portion 53. The front slanting surfaces 55 of the contact plate portions 53 serve as guide surfaces for the insulating plate 23 (see FIG. 10) shown in the prior art, and the rear slanting surfaces 57 serve as guide surfaces for the terminals 37.

A retaining pawl 61 is formed on a bottom surface of the short-circuiting member receiving chamber 45, and the retaining pawl 61 is retainingly engaged in a retaining hole 63 formed through a bottom wall of the short-circuiting member 51. The short-circuiting member receiving chamber 45 is open at its rear end to form an insertion port 65 for inserting the short-circuiting member 51 therethrough. When inserting the short-circuiting member 51 into the short-circuiting member receiving chamber 45, the contact plate portions 53 are first inserted at their front ends into the insertion port 65, and are resiliently deformed. When the short-circuiting member 51 is inserted into the short-circuiting member receiving chamber 45, the contact plate portions 53 are resiliently restored to press-contact the step portions 49, respectively. The rear slanting surface 57 of each contact plate portion 53, press-contacted with the step portion 49, is disposed in a path of insertion of the associated terminal 37. As-shown in FIGS. 1 and 2, bottom surfaces 33*a* of the terminal receiving chambers 33 are disposed slightly below the step portions 49.

In this connector structure, when each terminal 37 is inserted through the mounting port 39 of the associated terminal receiving chamber 33, the distal end of the terminal 37 abuts against the rear slanting surface 57 of the associated contact plate portion 53, and when the terminal 37 is further inserted, the terminal 37 presses the contact plate portion 53 downward. Then, the depressed contact 59 is brought into press-contact with the lower surface of the terminal 37, mounted in the terminal receiving chamber 33, with a large restoring force. At this time, the press-contact force is usually the sum of the force of press-contact of the contact plate portion 53 with the step portion 49 and the resilient restoring force resulting from the depressing of the contact plate portion 53 by the terminal 37.

The terminals 37, mounted respectively in the pair of terminal receiving chambers 33, are short-circuited together through the short-circuiting member 51, and electric current, induced by electromagnetic waves and static electricity, is removed, thereby positively preventing a malfunction of an electronic circuit.

Figure 10:
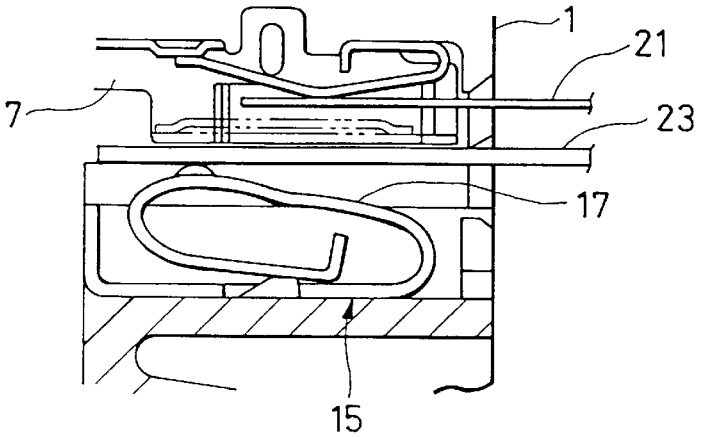
FIG. 10 is a cross-sectional view showing a condition in which terminals and an insulating plate of a mating connector are inserted into the connector of FIG. 8.
Figure 11:
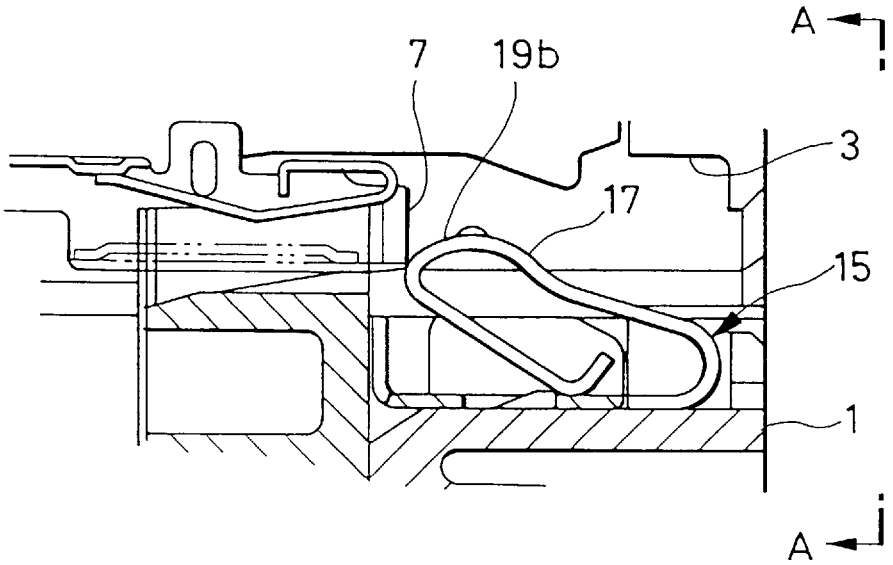
FIG. 11 is a cross-sectional view showing the related connector, showing the process of inserting a terminal.
Figure 12:
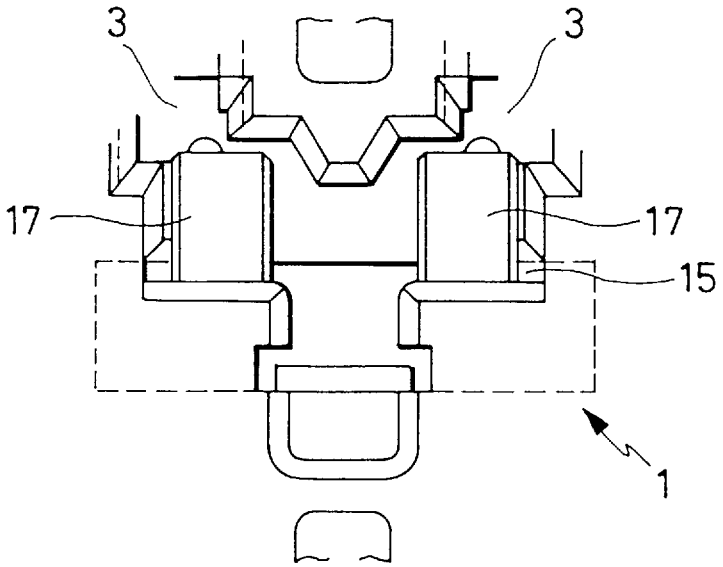
FIG. 12 is a cross-sectional view taken along line XII—XII of FIG. 11.

When a mating connector is connected, the insulating plate of the mating connector is inserted between the pair of contact plate portions 53 and the pair of terminals 37 as shown in FIG. 10, thereby interrupting the electrical connection between the terminals 37 and the short-circuiting member 51.

As described above, in this connector structure, the step portion 49 is provided at the terminal receiving chamber 33, and the contact plate portion 53 is abutted against the step portion 49, and therefore the amount of projection of the contact plate portion 53 into the terminal receiving chamber 33 is limited to a predetermined level, and the slanting surface 57 is disposed in the path of insertion of the terminal 37. As a result, the terminal 37 can positively abut against the slanting surface 57, and will not force the contact plate portion 53 upward, but can positively press the same downward.

Each of the step portions 49 limits the position of the associated contact plate portion 53 in press-contacted relation thereto, and therefore a sufficient pressure of contact between the contact plate portion 53 and the terminal 37 can be obtained, and hence the contact reliability is enhanced.

Figure 3:
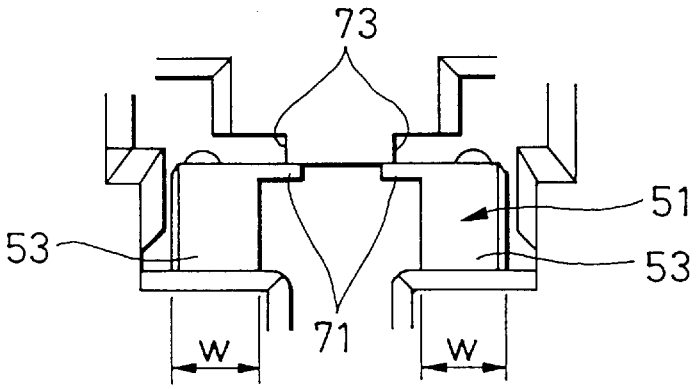
FIG. 3 is a front-elevational view showing a second embodiment of a connector structure of the invention.
Figure 4:
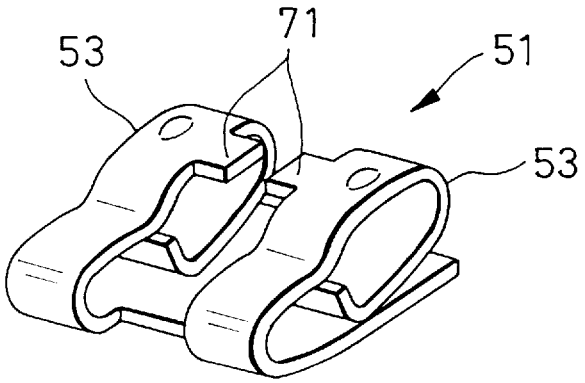
FIG. 4 is a perspective view of a short-circuiting member shown in FIG. 3.

Next, a second embodiment of a connector structure of the invention will be described with reference to FIGS. 3 and 4. FIG. 3 is a front-elevational view showing the second embodiment of the connector structure of the invention, and FIG. 4 is a perspective -view of a short-circuiting member shown in FIG. 3. In the connector structure of this embodiment, contact plate portion urging means are constituted by plate-like holder portions 71, formed respectively on contact plate portions 53 of the short-circuiting member 51, and step portions 73 formed on a housing 31.

The holder portions 71 are formed respectively at opposed side edges of the pair of contact plate portions 53 and 53 in the vicinity of peak portions thereof, and extend horizontally toward each other. The distance between the step portions 73 and 73 is smaller than the distance between the above-mentioned step portions 49 and 49 so that the step portions 73 and 73 can abut only against the holder portions 71 and 71, respectively.

Therefore, when the short-circuiting member 51 is inserted into a short-circuiting member receiving chamber 45, the holder portions 71 are press-contacted with the step portions 73, respectively, and a slanting surface 57 (see FIG. 1) of each of the contact plate portions 53 is disposed in a path of insertion of the associated terminal 37.

In this connector structure, each holder portion 71 is abutted against the associated step portion 73, and therefore the amount of projection of the contact plate portion 53 into the terminal receiving chamber 33 is limited to a predetermined level, and the contact plate portion 53 is prevented from being forced upward by the terminal 37, and a sufficient pressure of contact between the contact plate portion 53 and the terminal 37 can be secured.

In the connector structure of this embodiment, the holder portion 71 projects from the contact plate portion 53, and this holder portion 71 is pressed by the step portion 73, thereby pressing down the contact plate portion 53. Therefore, a width "w" of each contact plate portion 53 can be reduced, and the cost of the short-circuiting member 51 can be reduced.

Figure 5:
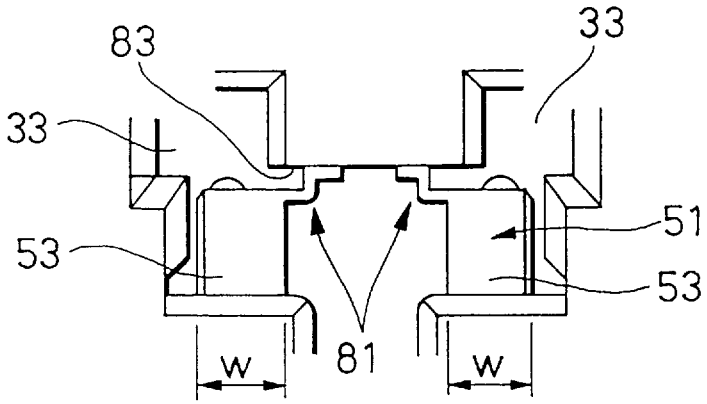
FIG. 5 is a front-elevational view showing a third embodiment of a connector structure of the invention.
Figure 6:
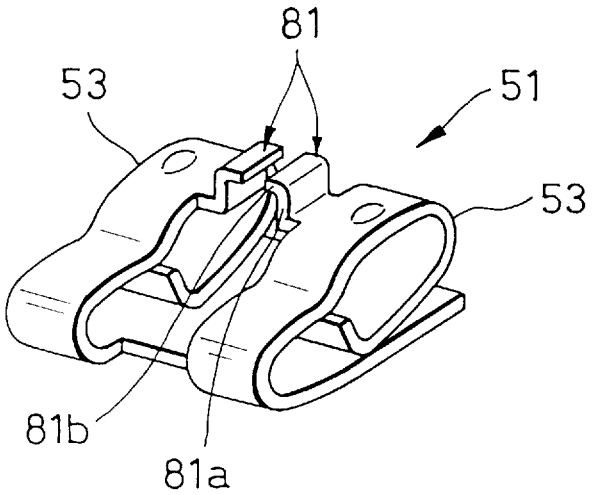
FIG. 6 is a perspective view of a short-circuiting member shown in FIG. 5.

Next, a third embodiment of a connector structure of the invention will be described with reference to FIGS. 5 and 6. FIG. 5 is a front-elevational view showing the third embodiment of the connector structure of the invention, and FIG. 6 is a perspective view of a short-circuiting member shown in FIG. 5. In the connector structure of this embodiment, contact plate portion urging means is constituted by holder portions 81 formed respectively on contact plate portions 53 of the short-circuiting member 51.

The holder portions 81 are formed respectively at opposed side edges of the pair of contact plate portions 53 and 53 in the vicinity of peak portions thereof, and extend toward each other. Each of the holder portions 81 has a vertical portion 81*a* bent upwardly at a proximal end portion thereof, and a horizontal portion 81*b* extending from an upper end of the vertical portion 81*a* toward the horizontal portion 81*b* of the mating holder portion 81. The horizontal portions 81*b* are abutted against an upper surface (ceiling) 83 of the housing 31 (that is, a short-circuiting member receiving chamber 45). Thus, in the connector structure of this embodiment, the step portions 49 or the step portions 73 are not provided.

Therefore, when the short-circuiting member 51 is inserted into the short-circuiting member receiving chamber 45, the horizontal portions 81*b* of the holder portions 81 are press-contacted directly with the upper surface 83 of the short-circuiting member receiving chamber 45, and the slanting surface 57 (see FIG. 1) of each of the contact plate portions 53 is disposed in a path of insertion of the associated terminal 37.

In this connector structure, each of the holder portions 81 is abutted against the upper surface 83, and therefore the amount of projection of the contact plate portion 53 into the terminal receiving chamber 33 is limited to a predetermined level, and the contact plate portion 53 is prevented from being forced upward by the terminal 37, and a sufficient pressure of contact between the contact plate portion 53 and the terminal 37 can be secured.

In the connector structure of this embodiment, each holder portion 81 is press-contacted directly with the upper surface 83 of the short-circuiting member receiving chamber 45, thereby limiting the contact plate portion 53 to the predetermined height. Therefore, as in the second embodiment, a width "w" of each contact plate portion 53 can be reduced, and the formation of the step portions 49 or 73 is unnecessary, so that the housing 31 can be of a simple structure.

Figure 7:
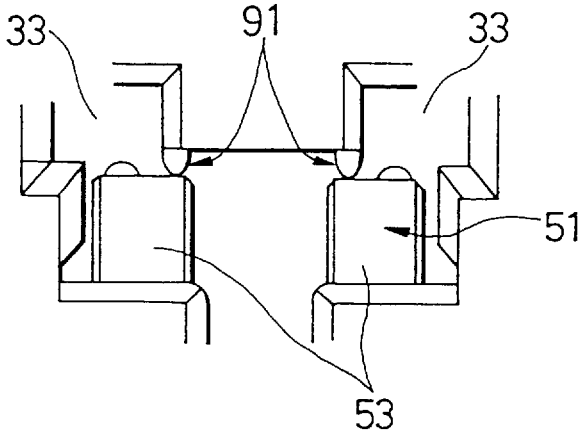
FIG. 7 is a front-elevational view showing a connector structure of the invention in which projections are formed instead of step portions.
Figure 8:
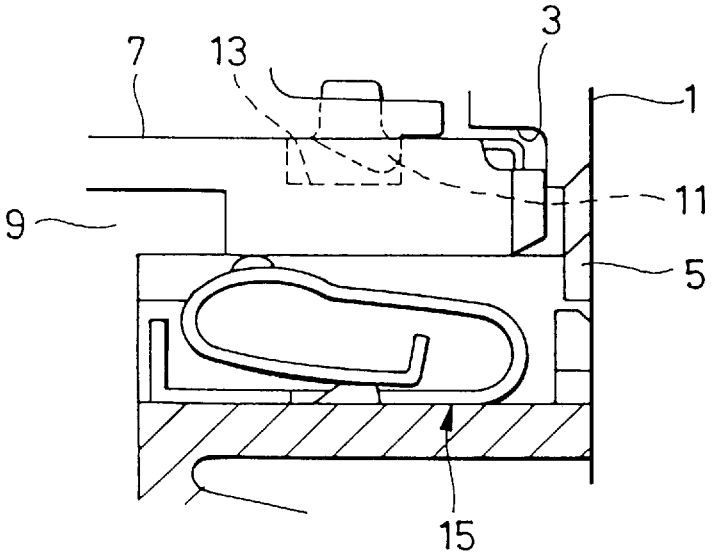
FIG. 8 is a cross-sectional view of a related connector structure having a short-circuiting member.
Figure 9:
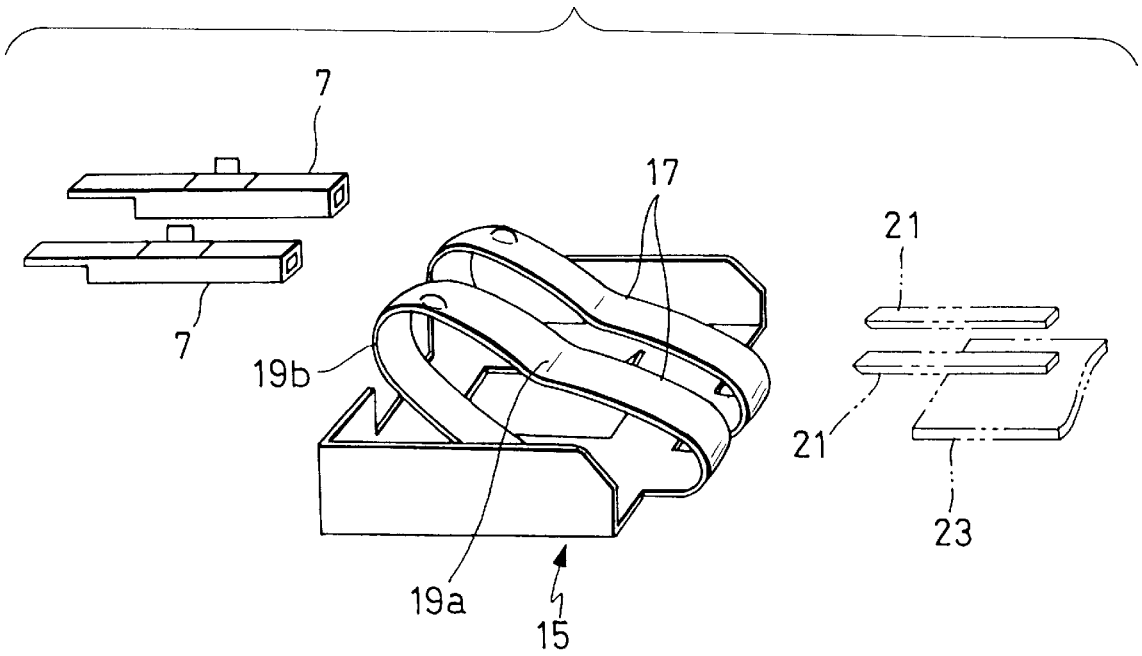
FIG. 9 is an exploded, perspective view of an important portion of the related connector structure.

In the first and second embodiments, the step portions 49, 73, which are not continuous with each other in a horizontal plane, are formed at the housing 31, and are press-contacted with the short-circuiting member 51. However, the step portions 49, 73, constituting the contact plate portion urging means, may be replaced by projections 91 as shown in FIG. 7.

In the structure having such projections 91, the volume and weight of a resin material, used to form the housing 31, can be made smaller as compared with the structure having the step portions 49, 73.

As described above in detail, in the connector structure of the invention, the contact plate portion urging means is formed, and the amount of projection of the contact plate portions is limited by this contact plate portion urging means, and therefore the slanting surface (serving as the guide surface for guiding the insertion of the terminal), formed on each of the contact plate portions, can be positively disposed in the path of insertion of the terminal. As a result, each terminal can be smoothly inserted, thus enhancing the terminal inserting ability. And besides, the position of each contact plate portion is limited, with the contact plate portion held in press-contact with the contact plate portion urging means, and therefore the large force of press-contact between the terminal and the contact plate portion is secured, and the contact reliability is enhanced.

What is claimed is:

1. A connector structure, COMPRISING:

a housing;

terminal receiving chambers formed in said housing;

a short-circuiting member receiving chamber communicating with said terminal receiving chambers;

a short-circuiting member having resilient contact plate portions which are resiliently urged in the same direction, said short-circuiting member being received in said short-circuiting member receiving chamber, so that said contact plate portions project respectively into said terminal receiving chambers to be press-contacted respectively with terminals to be mounted respectively in said terminal receiving chambers; and means for urging said contact plate portions against a resilient force of said contact plate portions thereby limiting an amount of projection of said contact plate portions into said terminal receiving chambers prior to insertion of said terminals to be mounted respectively in said terminal receiving chambers.

2. A connector structure according to claim 1, in which said contact plate portion urging means is one selected from the group consisting of step portions provided on said housing and projections provided on said housing.

3. A connector structure according to claim 1, in which said contact plate portion urging means includes holder portions provided respectively on said contact plate portions, said holder portions being press-contacted with said housing.

4. A connector structure according to claim 3, wherein said holder portions are formed on respective opposite side edges of said contact plate portions, said holder portions extending toward each other away from the respective side edges of the contact plate portions.

* * * * *